United States Patent [19]

Filby

[11] Patent Number: 4,514,305

[45] Date of Patent: Apr. 30, 1985

[54] AZEOTROPIC DEHYDRATION PROCESS FOR TREATING BITUMINOUS FROTH

[75] Inventor: John E. Filby, Calgary, Canada

[73] Assignee: Petro-Canada Exploration, Inc., Calgary, Canada

[21] Appl. No.: 446,029

[22] Filed: Dec. 1, 1982

[51] Int. Cl.[3] ..... C10G 33/04

[52] U.S. Cl. ..... 210/703; 210/774; 203/69; 208/11 LE; 208/188

[58] Field of Search ..... 203/69; 208/11 R, 11 LE, 208/188; 210/774, 750, 703–705, 718

[56] References Cited

U.S. PATENT DOCUMENTS

| | | | |
|---|---|---|---|
| 3,468,789 | 9/1969 | Balassa | 208/188 |
| 3,796,652 | 3/1974 | Lupul | 208/188 X |
| 4,139,450 | 2/1979 | Hanson et al. | 208/11 LE |
| 4,385,982 | 5/1983 | Anderson | 208/11 LE |

*Primary Examiner*—Thomas Wyse

*Attorney, Agent, or Firm*—William R. Hinds; George H. Dunsmuir

[57] ABSTRACT

Bituminous froths, typically obtained from the known Hot Water Method of extraction treatment of oil sands, are processed to remove water and part of the coarse mineral solids contained in the froth. In the process, the froth feed stock from the Hot Water Method treatment is mixed with a naphtha diluent, preferably naphtha which is derived from upgrading or refining of separated bitumen, in preferably the minimum amount sufficient to effectively remove all water by azeotropic distillation, while providing a workable feed viscosity. The mixture of naphtha and froth is treated to remove coarse solids and part of the water in a settling device, heated to a temperature sufficient to cause vaporization of the naphtha and remaining water as an azeotrope and flashed to substantially separate all water and naphtha from the bitumen. The dry bitumen with remaining solids, is normally not suitable for passing to a refinery but rather is sent to upgrading at a typical oil sands mining upgrading complex. Naphtha is recovered and recycled. The naphtha, in addition to its azeotrope forming feature, makes the froth more homogenous, less viscous, easier to handle and less fouling in heat exchangers, facilitates separation of coarse solids, and eliminates severe foaming when the froth is heated.

13 Claims, 1 Drawing Figure

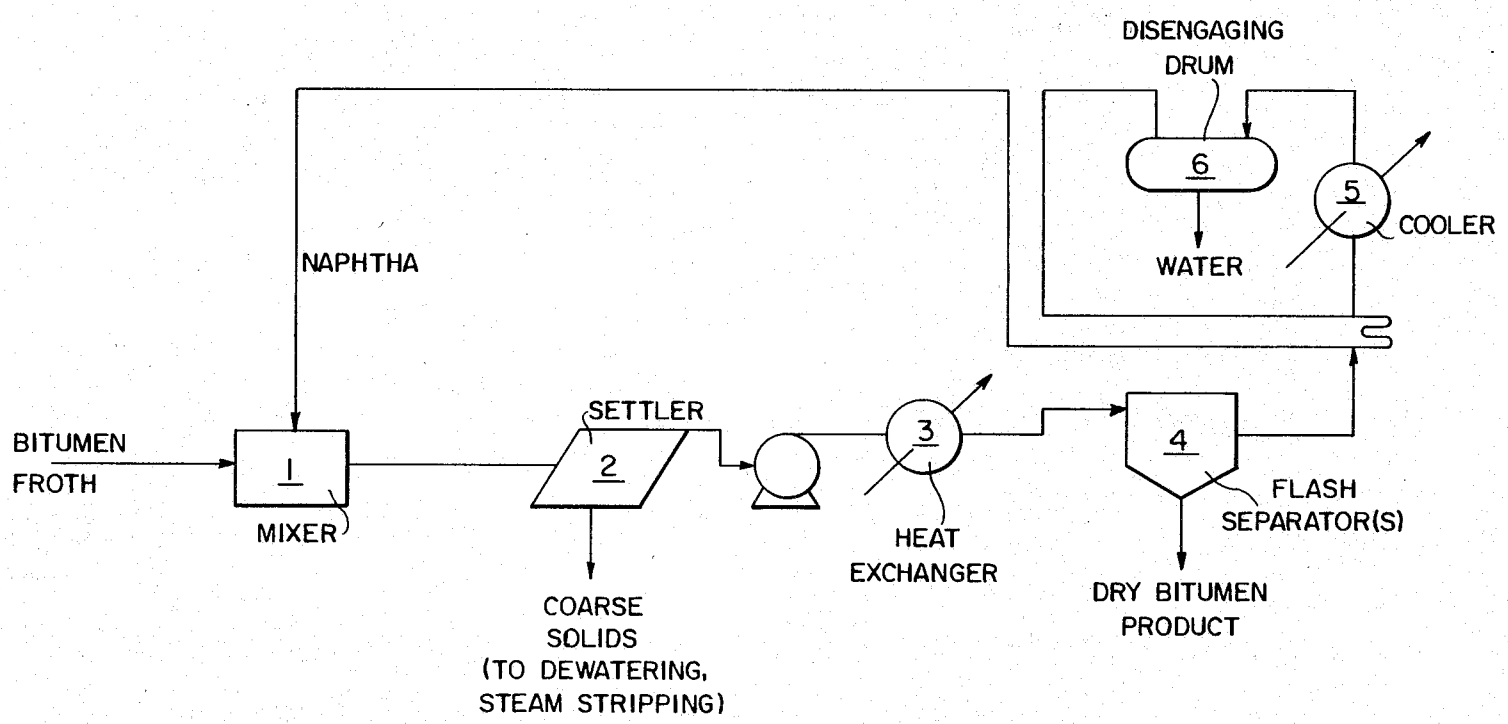
COOLER
5
DISENGAGING DRUM
6
WATER
FLASH SEPARATOR(S)
4
DRY BITUMEN PRODUCT
3
HEAT EXCHANGER
SETTLER
2
COARSE SOLIDS (TO DEWATERING, STEAM STRIPPING)
NAPHTHA
1
MIXER
BITUMEN FROTH

AZEOTROPIC DEHYDRATION PROCESS FOR TREATING BITUMINOUS FROTH

FIELD OF THE INVENTION

This invention relates to a process for removing water and part of the coarse solids from bituminous froths which contain appreciable quantities of mineral solids. The invention thus finds an important application as one of the operations in a combination of operations by which bitumen is extracted from oil sand or tar sands.

BACKGROUND OF THE INVENTION

A substantial proportion of the world's hydrocarbon reserves exists in the form of oil sand or tar sand. Throughout this application the term "bituminous sand" is used to include those materials commonly referred to as oil sand, tar sand and the like. One of the extensive deposits of bituminous sand is found along the banks of the Athabasca River in the Province of Alberta, Canada. In treating the tar sand to recover commercially saleable products, it is first necessary to separate the bitumen from the water and sand.

Typically bituminous sands comprise water-wet grains of sand sheathed in films of bitumen, and contain from about 6% to about 20% bitumen, from about 1% to about 10% water, and from about 70% to about 90% mineral solids. The major portion, by weight, of the mineral solids in bituminous sand is quartz sand having a particle size greater than about 45 microns and less than about 2000 microns. The term "solids" is used herein to describe material of inorganic origin such as sand, clay and the like, as distinguished from materials of organic origin such as coke. The remaining mineral solid material found in bituminous sands has a particle size of less than about 45 microns and is referred to as fines. Fines contain clay and silt including some very small particles of sand. The fines content will vary from about 10% to about 30% by weight of the total solid mineral content of bituminous sand. It is not uncommon for the ingredients of bituminous sand to vary from the mentioned concentrations.

Various methods are known for separating bitumen from bituminous sand. Many of these methods involve, as part of the overall separation process, the use of water to prepare slurries from which the coarse solids and portions of the fines are separated by various means such as settling to recover a bituminous froth which contains some of the fines and quantities of coarse solids.

Although the bituminous froths employed as the feed stock for the process of this invention are not necessarily critically dependent on any particular technique of water extraction of bituminous sand, one well known extraction method for preparing such froths particularly suited for the instant invention is commonly referred to as the Hot Water Method. In broad outline this method involves contacting the oil sand in a tumbler with hot water and steam. The water is supplied at a temperature of about 80° C. and in an amount sufficient to produce a slurry containing about 20% to 25% by weight water. The steam is supplied in an amount sufficient to ensure that the slurry temperature is about 80° C. During slurrying the bitumen films are ruptured and a preliminary separation of the sand grains and bitumen flakes takes place. At the same time, air bubbles are entrained in the slurry. More hot water is added to the slurry after it leaves the tumbler. Typically, this might raise the slurry water content to about 50% by weight. The diluted slurry is then introduced into a separator cell containing a body of hot water. The contents of the cell are commonly maintained at about 80° C. In the cell the bitumen particles, which have been attached to air bubbles, tend to rise to the surface of the water body and form an oily primary froth. This froth is recovered in a launder running around the rim of the cell. The coarse sand particles tend to sink to the bottom of the cell and are drawn off as tailings. A middling stream, comprising water, fine solids (minus about 44 microns) and some bitumen, is continuously withdrawn from the cell at a point intermediate its ends. This middling stream is treated in a sub-aerated flotation cell to recover the contained bitumen in the form of secondary froth. The primary and secondary froths are combined and transferred into a holding tank to remove some of the contained water and solids.

Another well-known technique is known as the Cold Water Method in which the separation is accomplished by mixing the sands with a solvent capable of dissolving the bitumen constituent. The mixture is then introduced into a large volume of water, or water with a surface agent added, or a solution of neutral salt in water.

The Hot Water Method, Cold Water Method and others are extensively described in the literature, and do not form part of the present invention. However, these processes, particularly and preferably the Hot Water Method, do produce the feed stock, bitumen froth containing solids and water, which is treated in accordance with the process of this invention. While the composition of the bituminous froth can vary, it typically comprises about 30% by weight water, about 10% solids and about 60% bitumen. Before the bitumen in the emulsion can be treated to recover saleable products, it is necessary to remove at least most of the water therefrom.

Various proposals have been set forth in the prior art for dehydration of such froths or similar emulsions. For example, one such proposal, as exemplified by Canadian Pat. No. 918,091 proposes dehydration by the bituminous froth with a light diluent naphtha, followed by centrifugation of the product to remove the water and solids. This dehydration system however, involves expensive high-wear equipment and results in substantial losses of bitumen and diluent naphtha with the tailings. As a further example, Canadian Pat. No. 792,734 describes a process wherein water is removed from the bituminous froth by thermal dehydration. In this process the emulsion or froth is heated indirectly in an exchanger with steam to vaporize the water, and the water vapour is subsequently flashed off. It is believed that this process has not been pursued mainly because of the difficulty encountered in heating a non-homogenous mixture such as bituminous froth, and subsequent problems with exchanger fouling caused by clay left behind from the froth.

U.S. Pat. No. 3,468,789 discloses a process wherein an aromatic solvent is added to an equal weight of oil emulsions containing appreciable quantities of solids. The solvent, after some time, causes separation of the froth into three layers, i.e. oil/solvent phase, emulsion or interface, and aqueous phase, some or all of which are treated separately. In this proposed process, emulsified oil which is essentially free of solids is dehydrated by distillation. The aromatic solvent acts as an entrainer and removes the water by azeotrope formation. The aromatic solvents described are expensive and are used in large amounts and the three phase separator poses a difficult design problem, which probably limits the practicality of scale-up to commercial size. The patent (U.S. Pat. No. 3,468,789) also proposes to dissolve the oil emulsion with an equal weight of a solvent capable of forming an azeotrope with water, and, without waiting for the solution to separate into layers as aforesaid, to subject it to azeotropic distillation to remove the water. The oil-wet silt then can be removed from the dehydrated oil/solvent/silt solution either by settling or by means of a centrifuge. The silt is freed of traces of oil by washing with solvent and is then stripped of solvent with steam, and discarded. The solvent is stripped from the post-dehydration oil-solvent solution by distillation and the solvent is replaced in the solution by a low cost distillate diluent for pipelining to a refinery. Like the process of Canadian Pat. No. 792,734 this process may have problems with exchanger and distillation column fouling caused by solid materials. Using equal amounts by weight of fairly expensive solvent is of questionable practicality.

Canadian Pat. No. 792,734 also summarizes various other methods or procedures for treating bituminous emulsions or froths, including gravity settling of solids and wwter after dilution with light solvent, such gravity settling but with elevated temperature and pressure, such gravity settling but with the addition of chemicals to reduce the interfacial tension of the system, and electrostatic treatment after dilution with light solvent. However, as understood by me, the various procedures for breaking bituminous emulsions in recovering the bitumen suffer from various practical shortcomings, such as incomplete separation, high cost, operational problems, etc.

In general, it is an object of this invention to provide a simple but improved process for removing water and part of the coarse solids from bituminous froths, particularly those obtained in the Hot Water Method of extraction treatment of oil sands or tar sands.

Other objects and advantages of this invention will become apparent to those skilled in the art, from the ensuing description of preferred embodiments and examples.

DESCRIPTION OF THE DRAWING

The single drawing FIGURE is a flow diagram illustrating a presently preferred embodiment of the process and apparatus for carrying out the process.

DESCRIPTION OF PREFERRED EMBODIMENTS OF THE INVENTION

The invention provides a simple, straightforward and economical process for the dehydration of bituminous froths containing water. The process generally comprises mixing the bitumen froth with a diluent naphtha, removing part of the solids, heating the resulting mixture to a temperature sufficient to cause vaporization of the naphtha and water as an azeotrope, and separating the water and naphtha from the bitumen, this separating being preferably accomplished by flashing the product mixture and separating the vaporized naphtha-water azeotrope from the bitumen. Thus, in accordance with this embodiment of the invention, there is provided a method for separating the water, coarse solids and bitumen contained in a bituminous froth obtained by admixing water with bituminous sands in order to recover bitumen, which comprises (i) mixing said froth with a diluent capable of forming an azeotrope with water; (ii) azeotropically dehydrating the resulting mixture of step i to continuously remove the water and diluent therefrom, thereby obtaining a substantially dry bitumen product suitable for further refining or upgrade processing; (iii) collecting the azeotropic distillate from ii, said distillate comprising water and diluent phases, and (iv) separating the diluent phase from the aqueous phase of the azeoptropic distillate collected in iii.

In an especially preferred embodiment, relatively inexpensive naphtha derived from upgrading or refining of separated bitumen is employed as the diluent. Preferably the diluent/froth mixture is first treated to remove coarse solids prior to the azeoptropic dehydration step. This step is particularly preferred when the solids content of the froth feed stock is greater than 5% by weight.

Employment of a diluent such as naphtha has several advantages. For example, the viscosity of the bituminous froth is lowered, thereby making the froth easier to handle and permitting ease of separation of coarse solids. Furthermore, the use of a diluent which forms an azeotrope with water provides a simple straightforward and economical vehicle for removal of water from the bituminous froth. The use of a naphtha diluent makes the froth more homogenous and facilitates handling in conventional heat exchangers without substantial fouling. The presence of a diluent also eliminates severe foaming and bumping observed when undiluted froth is heated.

Referring to the flow diagram and diagrammatic apparatus illustrated in the drawing, the bitumen froth feed stock is first mixed with a naphtha diluent in a low energy mixer 1, preferably of the static type. Both the froth and naphtha streams are pre-heated to approximately 70 C. to facilitate this mixing. From the mixer 1, the diluted froth is passed to a settling device 2 where part of the solids (generally those of size greater than about 325 mesh) and excess water are removed. Since the purpose of this separation step is not to obtain a clean separation of solids and water but rather to remove those constituents which will separate easily, several known devices including clarifiers, cyclones, inclined plate separators, solvent extraction contractors or solid bowl centrifuges can be effectively employed. Coarse solids from this separation step can be dewatered as for example in a cyclone separator or a centrifuge, and if required can be steam stripped to recover traces of diluent. Removal of water prior to such steam stripping greatly improves the economics of this step. The diluent thus recovered can be recycled to feed diluent.

Upon such removal of coarse solids and water, the diluent/froth mixture typically contains from about 20 to about 25% water and from about 1 to about 3% solids. This mixture is then passed, by pumping or otherwise, to heat exchanger 3 where the mixture is then heated with steam in the heat exchanger to a temperature in the range of from about 200° C. to about 500° C. and preferably from about 200° C. to about 300° C. This heated mixture is then passed to a flash separator 4 (or a series of separators) where the water and diluent azeotrope is flashed off. The separator(s) preferably are designed for good liquid/vapour disengaging and preferably are of the tangential feed type. Separator pressure is typically maintained from about 9 to about 100 PSIG, and preferably from about 0 to 15 PSIG. Separator bottoms are recovered, and these comprise dried bitumen containing varying amounts of solids, generally up to about 5 weight percent solids. This product is suitable for further upgrade processing but normally is not suitable for a refinery.

Vapours taken from the top of separator 4 are condensed and then separated in a separating device or disengaging drum 6 into a water phase with a diluent phase. In the preferred embodiment, condensation and separation are accomplished first by countercurrent exchange with feed naphtha and then with water in cooler 5, followed by separation in disengaging drum 6 where recovered diluent can be recycled to the diluent feed stock.

From the foregoing, it will be seen that the present invention is easily adaptable to a continuous method for separating the water, coarse solids, and bitumen contained in a bituminous froth obtained by admixing water with bituminous sands in order to recover bitumen, which comprises; (a) continuously mixing said froth with a diluent (preferably naphtha) capable of forming an azeotrope with water; (b) separating part of the solids and water by, for example, decantation where coarse solids are present in appreciable amounts; (c) continuously azeotropically dehydrating the resulting mixture of step b, to continuously remove the water and diluent therefrom, thereby obtaining a substantially dry bitumen product suitable for further upgrade processing; (d) continuously collecting the azeotropic distillate from c, said distillate comprising water and diluent phases, and continuously withdrawing the dry bitumen obtained in c, (e) continuously separating the diluent phase from the aqueous phase of the azeotropic distillate collected in d, and (f) continuously recovering said separated diluent for recycling in the process and continuously recovering a purified water substantially free of diluent, bitumen and solids. The dehydrating is preferably effected by heating the mixture to a temperature sufficient to cause vaporization of all the naphtha and water as an azeotrope and flashing the mixture to substantially separate all water and naphtha from the bitumen.

Hydrotreated or non-hydrotreated naphthas in the boiling range of between about 50° C. to about 300° C. but preferably in the range of between about 70° C. to about 150° C. can be employed in the process of this invention. These diluents form binary constant azeotropes with water. Furthermore, such azeotropes boil at a temperature falling below the distillation point of the bitumen constituents of the bituminous froths treated in this invention, thus making it possible to separate the azeotrope from the bituminous froth by a simple flash separation. Other diluents forming similar azeotropes with water can be employed in the process of this invention, but naphtha is much preferred because it is inexpensive and can easily be derived for continuous processing from refining of the separated bitumen product. The type of diluent naphtha ultimately selected for utilization in a particular embodiment of the process of this invention may depend on the process chosen to refine or upgrade the bitumen product.

The percentage diluent utilized in the preparation of the diluent/froth mixture for economic reasons, preferably, is generally the minimum amount required to effectively remove substantially all the water from the froth by azeotropic distillation, such that the resulting bitumen product will be substantially free of water and diluent. In some instances diluent in excess of its minimum will be necessary to provide a workable viscosity of the feed. The percentage will vary with the type and boiling range of the specific diluent selected. When naphtha is employed as the diluent, as is generally preferred, the naphtha to bitumen weight ratio will typically fall within the range of about 0.4–1 to 1, and preferably in the range of about 0.5–0.7 to 1. A preferred weight ratio naphtha to water is about 0.7–1 to 1.

The process is exemplified by the following examples of continuous embodiments conducted on a bench scale. The feed stocks used were prepared by mixing bituminous froths with diluent naphtha of a hydrotreated-coker type having a nominal boiling range of 70° C. to 150° C. Water was added as necessary to achieve the desired concentrations as set forth in Table 1. The processing of these emulsions followed the general outline set forth in the drawing FIGURE, except that, because the solids content of the feed emulsions was fairly low (less than 5% by weight) no settling step was employed prior to the distillation stage. A small scale flash distillation unit having a capacity of 1 kg per hour of diluted froth was used. The heater in this unit was an aluminum cylindrical block which was heated electrically. Diluted froth was passed through a coil which was wound around the heater. The temperature of the heater was controlled automatically, and heater temperatures of 240° C. to 280° were employed. The separator used was of the tangential type. Each experiment consisted of three hours of continuous operation at the process conditions. The results are shown in Table 1. While all the examples are workable, they vary as to feasibility or practicality in a decreasing manner as the percentage of naphtha increases, with the last example being representative of the presently particularly preferred processes involving naphtha/bitumen and naphtha/water ratio of 0.65 to 1 and 0.72 to 1, respectively.

TABLE 1

Continuous Azeotropic Distillation Test Results

| | | Average Weight Percent | | | |
|---|---|---|---|---|---|
| Run No: | Stream | Naphtha | Bitumen | Water | Solids |
| 1 | Feed | 32.05 | 20.21 | 47.08 | 0.66 |
| | Distillate | 38.05 | 0.017 | 61.8 | 0.21 |
| | Bottoms | 1.00 | 95.76 | 1.61 | 2.64 |
| 2 | Feed | 31.91 | 23.39 | 43.94 | 0.76 |
| | Distillate | 37.75 | 0.047 | 62.05 | 0.15 |
| | Bottoms | 1.00 | 96.44 | 0.67 | 2.69 |
| 3 | Feed | 48.05 | 34.60 | 16.23 | 1.12 |
| | Distillate | 62.14 | 0.065 | 37.6 | 0.16 |
| | Bottoms | 2.24 | 93.65 | 0.00 | 4.12 |
| 4 | Feed | 34.92 | 50.25 | 12.80 | 1.53 |
| | Distillate | 67.88 | 0.30 | 31.36 | 0.47 |
| | Bottoms | 3.08 | 92.83 | 0.00 | 4.10 |
| 5 | Feed | 47.6 | 34.68 | 16.67 | 1.01 |
| | Distillate | 77.67 | 0.04 | 22.22 | 0.07 |
| | Bottoms | 5.15 | 91.04 | 0.00 | 3.99 |
| 6 | Feed | 25.17 | 38.57 | 35.06 | 1.17 |
| | Distillate | 41.96 | 0.01 | 57.87 | 0.16 |
| | Bottoms | 0.00 | 96.27 | 0.00 | 3.73 |

What I claim is:

1. A method for separating the water, coarse solids and bitumen contained in a bituminous froth obtained by admixing water with bituminous sands in order to recover bitumen which comprises: mixing said bituminous froth with a naphtha diluent capable of forming an azeotrope with water; separating part of the coarse solids from the mixture; heating the remaining mixture to a temperature sufficient to cause vaporization of said diluent and the water as an azeotrope; and flashing the heated mixture to substantially separate all water and diluent from the bitumen and remaining solids.

2. The process of claim 1 wherein said naphtha has a boiling point ranging from about 50° C. to about 300° C.

3. The process of claim 1 wherein said temperature ranges from about 200° C. to about 500° C.

4. The process of claim 1 wherein the amount of diluent employed is only about that amount required to effectively remove substantially all of the water from the said bituminous froth by azeotropic distillation.

5. The process of claim 1 wherein coarse solids of a size greater than 325 mesh are separated prior to heating.

6. The process of claim 1 wherein the recovered bitumen contains up to about 5 weight percent solids.

7. The process of claim 1 wherein the bituminous froth and diluent naphtha feed stocks are heated to approximately 70° C. prior to mixing.

8. The process of claim 1 wherein the flashing is carried out in a flash separator of the tangential feed type capable of good liquid/vapour disengaging and wherein the pressure in said flash separator is maintained from 0 to about 100 PSIG.

9. A continuous method for separating the water, coarse solids and bitumen contained in a bituminous froth obtained by admixing water with bituminous sands in order to recover bitumen, which comprises: (a) continuously mixing said froth with naphtha diluent capable of forming an azeotrope with water and in an amount only sufficient to remove the water by azeotropism; (b) separating part of the solids and water by decantation; (c) continuously azeotropically dehydrating the resulting mixture of step b, to continuously remove substantially all the water and diluent therefrom, thereby obtaining a substantially dry bitumen and solids product suitable for further upgrade processing; (d) continuously collecting the azeotropic distillate from c, said distillate comprising water and diluent phases and continuously withdrawing the dry bitumen obtained in c; (e) continuously separating the diluent phase from the aqueous phase of the azeotropic distillate collected in d; and (f) continuously recovering said separated diluent for recycling in the process and continously recovering a purified water substantially free of diluent, bitumen and solids.

10. A method as claimed in claim 9 wherein said dehydrating is effected by heating the mixture to a temperature sufficient to cause vaporization of all the naphtha and water as an azeotrope and flashing the mixture to substantially separate all water and naphtha from the bitumen.

11. A method as claimed in claim 10 wherein said bituminous froth was obtained by contacting bituminous sand with hot water and steam under conditions which cause bitumen particles to attach to air bubbles, and removing the froth so formed from the remainder of the slurry in the form of a bituminous froth comprising, by weight, approximately 30% water, 10% solids and 10% bitumen.

12. A method as claimed in claim 10 wherein the weight ratio of naphtha to water is about 0.7–1 to 1.

13. A method as claimed in claim 12 wherein the weight ratio of naphtha to bitumen is about 0.5–0.7 to 1.

* * * * *